US005927532A

United States Patent [19]

Traub

[11] Patent Number: 5,927,532

[45] **Date of Patent: *Jul. 27, 1999**

[54] VAPOR-SEAL CHILD RESISTANT CLOSURE AND CONTAINER PACKAGE

[75] Inventor: Donald A. Traub, Wayne, Ohio

[73] Assignee: Owens-Illinois Closure Inc., Toledo, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/840,480

[22] Filed: Apr. 21, 1997

[51] Int. Cl.[6] ..... B65D 53/00

[52] U.S. Cl. ..... 215/342; 215/349; 215/332; 215/222; 215/351; 215/232

[58] Field of Search ..... 215/342, 341, 215/350, 332, 222, 232, 351, 343–346, 349; 220/293

[56] References Cited

U.S. PATENT DOCUMENTS

| | | | |
|---|---|---|---|
| 574,379 | 1/1897 | Bouneu | 215/342 X |
| 836,677 | 11/1906 | Frey | 215/342 X |
| 954,897 | 4/1910 | Steininger et al. | 215/342 |
| 1,632,086 | 6/1927 | Lee . | |
| 2,722,338 | 11/1955 | Eshbaugh . | |
| 3,072,276 | 1/1963 | Nichols | 215/222 |
| 3,128,006 | 4/1964 | Rousselet . | |
| 3,344,942 | 10/1967 | Hedgewick | 215/332 X |
| 3,485,403 | 12/1969 | Hedgewick et al. . | |
| 3,860,136 | 1/1975 | Romney . | |
| 3,974,929 | 8/1976 | Montgomery . | |
| 4,053,078 | 10/1977 | Herr | 215/222 |
| 4,057,159 | 11/1977 | Fillmore et al. . | |
| 4,059,198 | 11/1977 | Mumford . | |
| 4,399,920 | 8/1983 | Swartzbaugh et al. | 215/222 X |
| 4,583,665 | 4/1986 | Barriac | 215/351 X |
| 5,004,111 | 4/1991 | McCarthy | 215/232 |
| 5,341,948 | 8/1994 | Gaeta | 215/232 |

*Primary Examiner*—Stephen K. Cronin
*Assistant Examiner*—Robin A. Hylton

[57] ABSTRACT

A child resistant package including a container having a base wall, side wall and opened end and a plurality of projections on the side wall having downwardly extending notches. A plastic closure has a base wall and a peripheral skirt and a plurality of lugs on the inner surface of the skirt for engaging the notches by relative rotation between the closure and the container. A plastic insert is interposed between the closure and the open end of the container and is normally retained by the closure before it is applied or reapplied to the container. The plastic insert has a central portion engaging the base wall of the closure, a peripheral portion engaging the open end of the container and an intermediate portion defining a spring between the central portion and the peripheral portion. Retaining beads on the closure retain the liner in position when the closure is removed. The liner may be sealed to the container as by induction sealing to seal the contents when the container is filled.

8 Claims, 2 Drawing Sheets

VAPOR-SEAL CHILD RESISTANT CLOSURE AND CONTAINER PACKAGE

This invention relates to child resistant closures and particularly to child resistant closure and container packages which are opened by axially movement of the closure and rotation of the closure relative to the container.

BACKGROUND AND SUMMARY OF THE INVENTION

Vapor seal child resistant closure and container packages are shown in U.S. Pat. No. 4,057,159 and 4,059,198. In U.S. Pat. No. 4,057,159 there is disclosed vapor-seal child resistant closure and container package wherein the container comprises a cylindrical plastic body which is molded in one piece and has circumferentially spaced, radially extending projections on the upper end thereof that have notches therein. The closure comprises a one-piece plastic body having a top panel and an annular depending skirt with circumferentially spaced lugs extending radially inwardly for engagement with the notches. An annular integral rim or abutment is provided on the annular surface of the top panel of the closure and depends downwardly therefrom. A unique two-piece, vapor-seal liner is interposed between the annular abutment and the lugs for engagement with the upper end of the container. The two-piece liner incorporates a resilient disk member which serves as a spring between the closure and container and a deformable disk positioned beneath the resilient disk which may be pressed into sealing engagement with the upper rim of the container to provide a vapor-tight seal between the closure and container.

In U.S. Pat. No. 4,059,198 there is disclosed a vapor seal child resistant closure and container package wherein the container comprises a cylindrical plastic body which is molded in one piece and has circumferentially spaced, radially extending projections on the upper end thereof that have notches therein. The closure comprises a one-piece plastic body having a top panel and an annular depending skirt with circumferentially spaced lugs extending radially inwardly for engagement with the notches. An annular integral rim or abutment is provided on the annular surface of the top panel of the closure and depends downwardly therefrom. A one-piece, vapor-seal liner is interposed between the annular abutment and the lugs for engagement with the upper end of the container. The one-piece liner comprises a disc member which engages the annular rim of the container and includes a downwardly depending plug member which provides a vapor-tight seal with the inside surface of the container. The liner also serves as a spring between the closure and the container to bias the closure lugs into engagement with the projections on the container.

Among the objectives of the present invention are to provide a vapor-seal child resistant closure and container package including a liner which provides a seal; wherein the liner remains with the closure when the closure is removed and is available for resealing; and wherein the liner can be preassembled in the closure before initial use of the closure.

SUMMARY OF THE INVENTION

In accordance with the invention, the child resistant package comprises a container having a base wall, side wall and opened end and a plurality of projections on the side wall having downwardly extending notches. A plastic closure has a base wall and a peripheral skirt and a plurality of lugs on the inner surface of the skirt for engaging the notches by relative rotation between the closure and the container. A plastic insert is interposed between the closure and the open end of the container and is normally retained by the closure before it is applied or reapplied to the container. The plastic insert has a central portion engaging the base wall of the closure, a peripheral portion engaging the open end of the container and an intermediate portion defining a spring between the central portion and the peripheral portion. Retaining beads on the closure retain the liner in position when the closure is removed. The liner may be sealed to the container as by induction sealing to seal the contents when the container is filled.

DESCRIPTION OF THE PREFERRED EMBODIMENT

Figure 1:
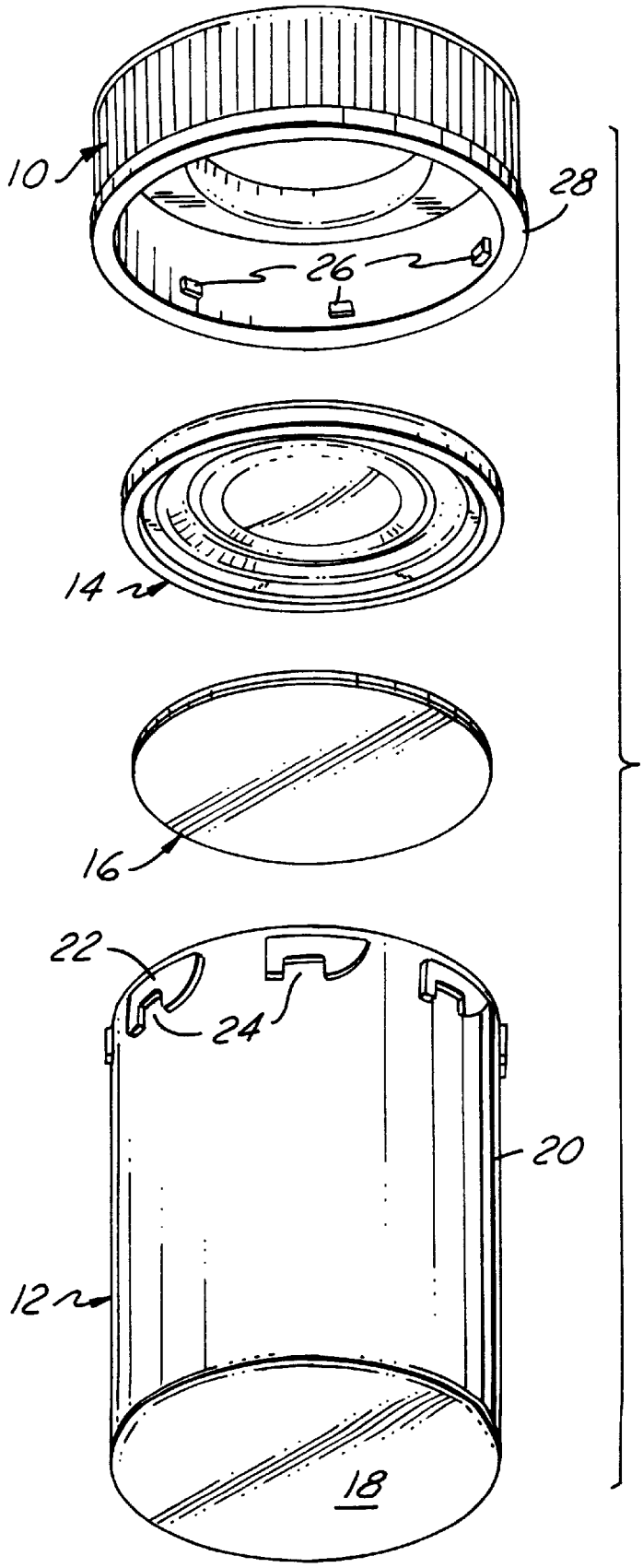
FIG. 1 is a perspective view of the package embodying the invention.
Figure 3:
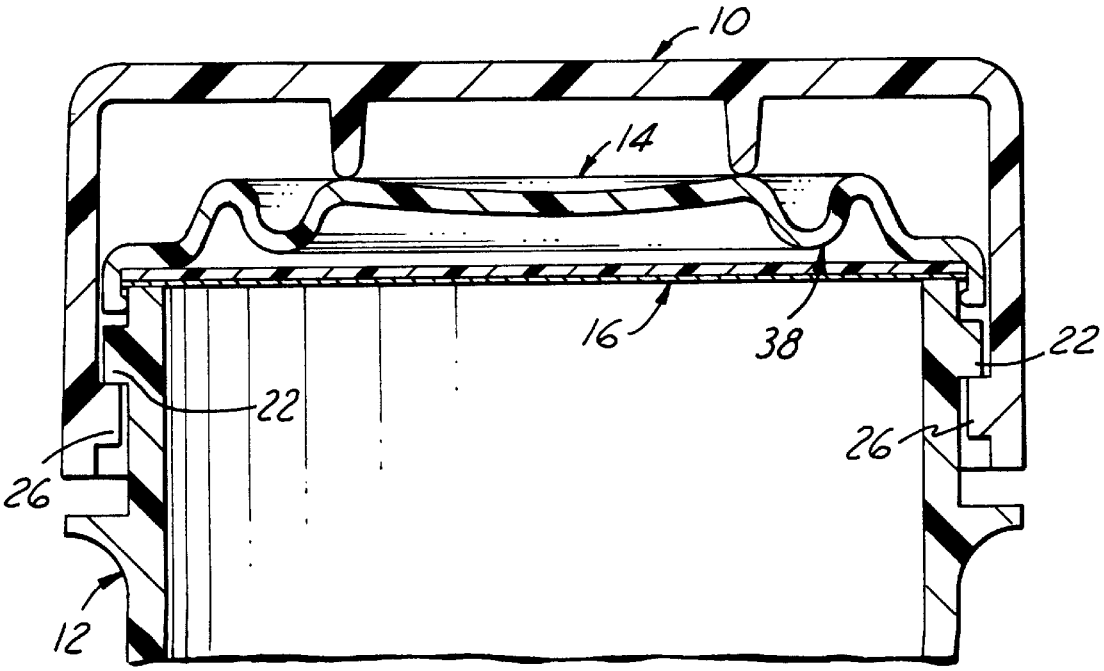
FIG. 3 is a fragmentary sectional view showing the closure applied to the container.

Referring to FIGS. 1 and 3, the vapor-seal child resistant closure and container package comprises a plastic closure 10, a plastic container 12, an insert 14 and a liner 16. The container 12 is shown in the form of a vial and comprises a base wall 18 and a side wall 20. The end of the container opposite the base wall is open and the outer surface of the side wall 20 has a plurality of circumferentially spaced projections 22 adjacent the opening, each of which is formed with a notch 24 for engagement by circumferentially spaced lugs 26 on the inner surface of the skirt 28 of the closure 10. The closure 10 further includes a base wall 30 and an annular inner wall 32 that extends downwardly from the under surface of the base wall 30.

Figure 2:
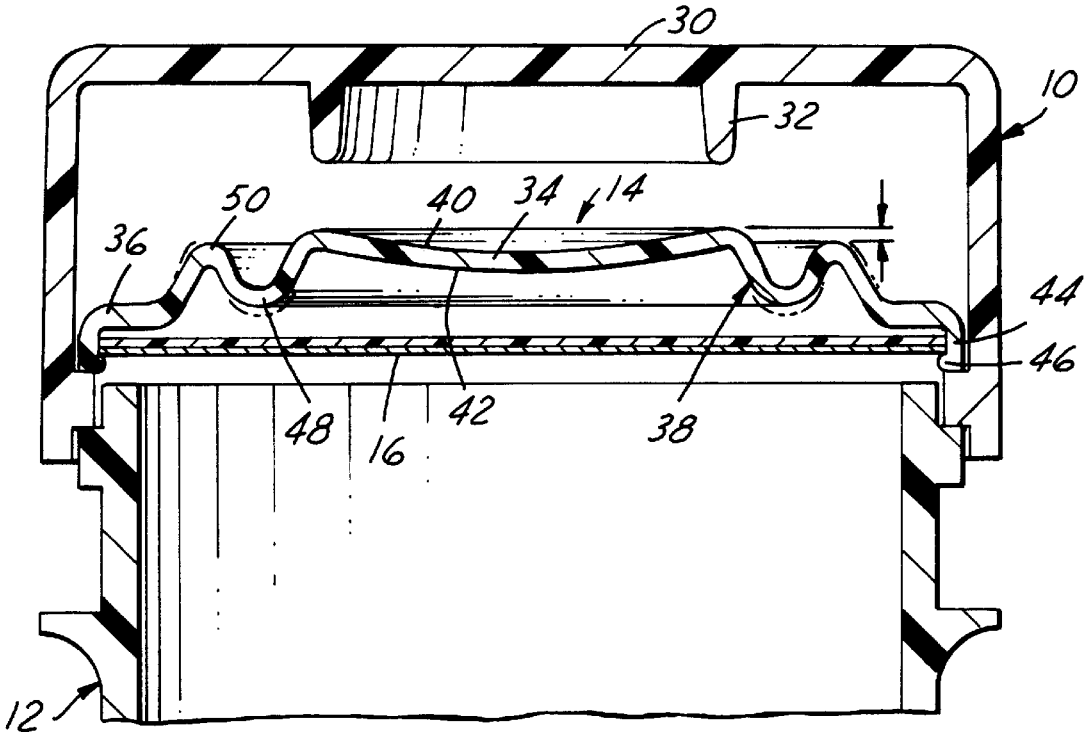
FIG. 2 is a fragmentary sectional view of the closure before application to the container.

Insert 14 comprises a central portion 34, a peripheral portion 36 and an intermediate flexible portion 38. The central portion 34 is of generally uniform thickness and includes an upper concave surface 40 and a lower downwardly convex surface 42. The peripheral portion 36 includes a short axial wall 44 having an annular bead 46 extending radially inwardly in the form of a continuous bead or an interrupted bead for retaining the liner 16 within the closure 10 when the closure 10 is removed. As best seen in FIGS. 2 and 3, bead 46 has an inner diameter which is less than the outer diameter of liner 16. The intermediate portion 38 of the insert 14 comprises a first V-shaped portion 48 connected to the central portion 34 and extending axially inwardly of the container 12 and an inverted V-shaped portion 50 connected to the V-shaped portion 48 and to a horizontal portion of the peripheral portion 36. As best seen in FIGS. 2 and 3, the inner diameter of lugs 26 is less than the outer diameter of insert 14.

The container 12 is preferably made of polypropylene or polyethylene. The closure 10 is preferably made of polypropylene. The insert 14 is preferably made of polyethylene. The liner 16 may be made of multiple layers of paper with a foil facing the container 12 for induction or conduction sealing. Alternatively, liner 16 may comprise a foam for providing barrier properties without tamper evidence.

When the closure 10 is applied to the container, in moving from the position shown in FIG. 2 to FIG. 3, the annular wall 32 projecting inwardly from the base wall 30 of the closure 10 engages the central portion 34 of insert 14 at the juncture with the intermediate portion 38 and thereby applies an axial force to the insert 14 such that the insert 14 is deflected axially from the solid position shown in FIG. 2 to the broken line position shown in FIG. 2 thereby applying a spring force to cause the peripheral portion 36 to press against the liner 16 and hold the liner 16 in position on the upper end of the container 12. The construction permits the liner 16 to be made of multiple layers including a foil layer that can be bonded in the initial use of the package by induction sealing.

It can thus be seen that there has been provided a vapor-seal child resistant closure and container package including a liner which provides a seal; wherein the liner remains with the closure when the closure is removed and is available for resealing; and wherein the liner can be preassembled in the closure before initial use of the closure.

I claim:

1. A child resistant package that comprises:

a container having a cylindrical sidewall with an open end and a plurality of spaced outer projections with notches opening axially and radially away from said open end, a plastic closure having a base wall, a peripheral skirt and a plurality of spaced inner lugs on said skirt seated in said notches, a flat liner disk in said closure overlying said open end of said container and having an outer diameter and a thickness, and a plastic insert in said closure interposed between said base wall and said liner disk, said insert having a central portion engaging said closure base wall and spaced from said liner disk, a flat peripheral portion that urges a peripheral portion of said flat liner disk into sealing engagement with said open end of said container, and a resilient intermediate portion spaced from said liner disk and interconnecting said central and peripheral portions of said insert, said insert peripheral portion having an axial wall with an inner diameter greater than said liner outer diameter and a bead extending radially inwardly from said axial wall at a position axially spaced by said axial wall from said flat peripheral portion of said liner by a distance greater than said liner thickness, said bead having an inner diameter less than said liner outer diameter such that said insert loosely captures said peripheral portion of said flat liner disk leaving said flat liner disk free to move between said bead and said insert peripheral portion, said insert having an outer diameter that is greater than an inner diameter of said inner lugs on said skirt to retain said insert and said liner within said closure when said closure is removed from said container, said insert functioning both to urge said peripheral portion of said liner disk against said open end to seal against said open end of said container, and to resist motion of said closure downwardly over said sidewall such that resiliency of said intermediate portion of said insert must be overcome to move said closure lugs downwardly out of said notches and then circumferentially to clear said projections to remove the closure, liner disk and insert as a unit from said container.

2. The child resistant package set forth in claim 1 wherein said intermediate portion comprises an annular portion having an undulating cross section.

3. The child resistant package set forth in claim 2 including an annular wall on said base wall engaging said central portion of said insert.

4. The child resistant package set forth in claim 1 wherein said liner is removably bonded to said open end of said container.

5. A method of forming a child resistant package that comprises the steps of:

(a) providing a container having a cylindrical sidewall with an open end and a plurality of spaced outer projections with notches opening axially and radially away from said open end, (b) providing a plastic closure having a base wall, a peripheral skirt and a plurality of spaced inner lugs on said skirt seated in said notches, (c) positioning a flat liner disk in said closure overlying said open end of said container and having an outer diameter and a thickness, (d) positioning a plastic insert in said closure interposed between said base wall and said liner disk, said insert having a central portion engaging said closure base wall and spaced from said liner disk, a flat peripheral portion that urges a peripheral portion of said flat liner disk into sealing engagement with said open end of said container, and a resilient intermediate portion spaced from said liner disk and interconnecting said central and peripheral portions of said insert, and (e) providing said insert peripheral portion with an axial wall having an inner diameter greater than said liner outer diameter and a bead extending radially inwardly from said axial wall at a position axially spaced by said axial wall from said peripheral portion of said liner by a distance greater than said liner thickness, said bead having an inner diameter less than said liner outer diameter such that said insert loosely captures said peripheral portion of said flat liner disk leaving said flat liner disk open to move between said bead and said insert peripheral portion, said insert having an outer diameter that is greater than an inner diameter of said inner lugs on said skirt to retain said insert and said liner within said closure when said closure is removed from said container, said insert functioning both to urge said peripheral portion of said liner disk against said open end to seal against said open end or said container, and to resist motion of said closure downwardly over said sidewall such that resiliency of said intermediate portion of said insert must be overcome to move said closure lugs downwardly out of said notches and then circumferentially to clear said projections to remove the closure, liner disk and insert as a unit from said container.

6. The method set forth in claim 5 wherein said step providing said intermediate portion comprises forming an annular portion having an undulating cross section.

7. The method set forth in claim 6 including an annular wall on said base wall engaging said central portion of said insert.

8. The method set forth in claim 5 including removably bonding said liner to said open end of said container.

* * * * *